US009215939B2

(12) United States Patent
Zobel et al.

(10) Patent No.: US 9,215,939 B2
(45) Date of Patent: Dec. 22, 2015

(54) RETAIL FIXTURES

(71) Applicant: Target Brands, Inc., Minneapolis, MN (US)

(72) Inventors: Erin L. Zobel, Minneapolis, MN (US); Jason W. Johnson, Wayzata, MN (US); Christopher A. Hammond, Edina, MN (US)

(73) Assignee: Target Brands, Inc., Minneapolis, MN (US)

( * ) Notice: Subject to any disclaimer, the term of this patent is extended or adjusted under 35 U.S.C. 154(b) by 163 days.

(21) Appl. No.: 14/053,153

(22) Filed: Oct. 14, 2013

(65) Prior Publication Data

US 2015/0102001 A1 Apr. 16, 2015

(51) Int. Cl.

| | |
|---|---|
| ***A47F 5/08*** | (2006.01) |
| ***A47F 1/04*** | (2006.01) |
| ***A47F 7/00*** | (2006.01) |
| ***A47F 7/17*** | (2006.01) |
| ***A47F 5/00*** | (2006.01) |
| *A47B 96/02* | (2006.01) |
| *A47F 1/12* | (2006.01) |

(52) U.S. Cl.

CPC ..... *A47F 5/0884* (2013.01); *A47F 1/04* (2013.01); *A47F 5/0025* (2013.01); *A47F 5/0823* (2013.01); *A47F 7/005* (2013.01); *A47F 7/0021* (2013.01); *A47F 7/17* (2013.01); *A47B 96/027* (2013.01); *A47F 1/12* (2013.01); *A47F 5/08* (2013.01)

(58) Field of Classification Search

CPC .... A47B 81/00; A47B 96/027; A47F 5/0838; A47F 5/0884; A47F 1/04; A47F 7/005; A47F 7/17; A47F 5/0025; A47F 5/0823; A47F 7/0021; A47F 1/12; A47F 5/08; B25H 3/04

USPC ..... 211/85.28, 44, 60.1, 70.2, 85.18, 88.01, 211/90.01, 90.02, 71.01; 220/476–483; 312/245, 114, 234.4; 108/92

See application file for complete search history.

(56) References Cited

U.S. PATENT DOCUMENTS

| | | | |
|---|---|---|---|
| 105,269 | A | 7/1870 | Spencer |
| 265,836 | A | 10/1882 | Lindner |
| 333,643 | A | 1/1886 | Lewis |

(Continued)

OTHER PUBLICATIONS

Office Action from Canadian Patent Application No. 2,839,574, mailed Apr. 10, 2014 (2 pages).

(Continued)

*Primary Examiner* — Joshua J Michener
*Assistant Examiner* — Devin Barnett
(74) *Attorney, Agent, or Firm* — Leanne Taveggia Farrell; Westman, Champlin & Koehler, P.A.

(57) ABSTRACT

A display fixture has a bin with multiple sections. A clip attached to a back panel of the bin has an aperture for receiving a fastener to fasten the bin to a peg board. A back support is mounted to the bin and has a downwardly extending leg that is sized to fit between the peg board and a back surface of a base that the display fixture is seated upon. The bin includes a lower tier of product sections defined in part by a front panel and has a lower sign support with two legs attached to the front panel and a lower label holder connected between the two legs such that there is an open space defined between the two legs and between a top of the front panel and a bottom of the lower label holder. The bin also includes an upper tier of product sections.

15 Claims, 11 Drawing Sheets

(56) References Cited

U.S. PATENT DOCUMENTS

| | | | | | |
|---|---|---|---|---|---|
| 623,879 | A | * | 4/1899 | Brinkmann | 220/479 |
| 731,710 | A | | 6/1903 | Renken | |
| 899,052 | A | * | 9/1908 | Imus | 108/25 |
| 979,261 | A | | 12/1910 | Compton | |
| 1,035,553 | A | * | 8/1912 | Doering | 211/55 |
| 1,113,350 | A | | 10/1914 | Inman | |
| 1,270,554 | A | | 6/1918 | Rubel | |
| 1,594,754 | A | * | 8/1926 | Reines | 108/61 |
| 1,595,437 | A | * | 8/1926 | Webster | 206/741 |
| 1,903,936 | A | * | 4/1933 | Nunnery | 211/69.5 |
| 1,951,695 | A | * | 3/1934 | Harter | 108/1 |
| 2,022,601 | A | | 11/1935 | McDonald | |
| 2,079,177 | A | | 5/1937 | Membrino | |
| 2,080,105 | A | | 5/1937 | Bacon | |
| D106,202 | S | | 9/1937 | Kane | |
| 2,209,690 | A | * | 7/1940 | Fraser | 62/251 |
| 2,275,542 | A | | 3/1942 | Menges | |
| 2,283,406 | A | | 5/1942 | Bacon | |
| 2,300,473 | A | | 11/1942 | Winkle | |
| 2,329,605 | A | | 9/1943 | Gladstein | |
| 2,340,373 | A | | 2/1944 | Gardner | |
| 2,458,578 | A | | 1/1949 | Evans | |
| 2,470,463 | A | * | 5/1949 | Botten | 119/65 |
| 2,540,707 | A | | 2/1951 | Beukelman | |
| 2,713,740 | A | | 7/1955 | Fessenden et al. | |
| 2,726,035 | A | * | 12/1955 | Meissner | 232/43.1 |
| 2,770,513 | A | * | 11/1956 | Brown | 220/482 |
| 2,982,423 | A | * | 5/1961 | Handler et al. | 211/126.1 |
| 3,090,271 | A | * | 5/1963 | Castelli | 83/614 |
| 3,131,511 | A | | 5/1964 | Deaner | |
| 3,134,485 | A | | 5/1964 | Bonkowski et al. | |
| 3,187,924 | A | * | 6/1965 | Marcus | 220/480 |
| 3,207,321 | A | * | 9/1965 | Joyce | 211/126.5 |
| 3,209,919 | A | * | 10/1965 | Hoogstoel | 211/90.02 |
| 3,225,805 | A | | 12/1965 | Wise | |
| 3,269,550 | A | * | 8/1966 | Marcus | 211/70.6 |
| 3,305,161 | A | | 2/1967 | Offer | |
| 3,313,333 | A | | 4/1967 | Lordi | |
| 3,330,405 | A | | 7/1967 | Taub | |
| 3,370,773 | A | | 2/1968 | Mayo | |
| 3,376,666 | A | | 4/1968 | Leonard | |
| 3,554,434 | A | | 1/1971 | Anderson | |
| 3,661,271 | A | * | 5/1972 | Fisher et al. | 211/88.01 |
| 3,734,275 | A | | 5/1973 | Greene | |
| 3,850,290 | A | | 11/1974 | Murphy | |
| D237,001 | S | | 9/1975 | Von Serda | |
| 3,908,215 | A | * | 9/1975 | Watson | 412/9 |
| 3,924,734 | A | * | 12/1975 | Gardner et al. | 206/736 |
| D244,259 | S | | 5/1977 | Bergstein | |
| 4,116,330 | A | * | 9/1978 | Ellis | 229/108 |
| 4,121,710 | A | | 10/1978 | Murphy | |
| 4,131,203 | A | * | 12/1978 | Bridges | 211/88.01 |
| 4,154,356 | A | * | 5/1979 | Schieve | 220/480 |
| 4,165,852 | A | * | 8/1979 | Chervenak | 248/223.41 |
| D257,526 | S | | 11/1980 | Herbst et al. | |
| 4,252,264 | A | | 2/1981 | Herbst et al. | |
| 4,403,700 | A | * | 9/1983 | Manlove | 211/88.01 |
| 4,415,077 | A | | 11/1983 | Murphy | |
| 4,542,930 | A | | 9/1985 | Adams | |
| D283,592 | S | | 4/1986 | Quarrell et al. | |
| 4,608,776 | A | | 9/1986 | Kooy | |
| 4,610,363 | A | | 9/1986 | Flum et al. | |
| 4,687,094 | A | * | 8/1987 | Allsop et al. | 206/774 |
| 4,700,847 | A | | 10/1987 | Shieh | |
| D296,630 | S | | 7/1988 | Renold et al. | |
| 4,828,121 | A | | 5/1989 | Willcocks, Jr. | |
| 4,846,394 | A | | 7/1989 | Swanson | |
| 4,955,677 | A | * | 9/1990 | Song | 312/290 |
| 5,000,344 | A | * | 3/1991 | Janssen | 221/92 |
| 5,031,826 | A | | 7/1991 | Seufert | |
| 5,052,570 | A | | 10/1991 | Johansen | |
| 5,083,663 | A | | 1/1992 | Conway et al. | |
| D327,093 | S | | 6/1992 | Evenson | |
| D327,965 | S | | 7/1992 | Chelec | |
| 5,148,932 | A | | 9/1992 | Orefice | |
| D330,512 | S | | 10/1992 | Ryberg | |
| D333,025 | S | | 2/1993 | Doherty | |
| 5,215,200 | A | * | 6/1993 | Rosenthal | 211/88.01 |
| 5,228,569 | A | | 7/1993 | House | |
| 5,230,423 | A | * | 7/1993 | Gellatly | 206/764 |
| 5,251,753 | A | * | 10/1993 | Pigott et al. | 206/766 |
| 5,328,732 | A | | 7/1994 | Renna | |
| 5,337,894 | A | | 8/1994 | Ivey | |
| 5,372,269 | A | | 12/1994 | Sutton et al. | |
| D357,886 | S | | 5/1995 | Fuller | |
| 5,415,343 | A | * | 5/1995 | Vosbikian | 229/162.3 |
| 5,471,783 | A | | 12/1995 | McLean | |
| 5,544,764 | A | | 8/1996 | Cima | |
| D376,284 | S | | 12/1996 | Keeley | |
| 5,598,942 | A | | 2/1997 | Cowie | |
| 5,617,960 | A | * | 4/1997 | Bishop | 211/60.1 |
| 5,695,061 | A | | 12/1997 | Stompe | |
| D392,144 | S | * | 3/1998 | Vogler | D6/574 |
| 5,743,416 | A | * | 4/1998 | Yemini | 211/70.6 |
| 5,826,730 | A | * | 10/1998 | Stravitz | 211/55 |
| 5,855,282 | A | * | 1/1999 | Hardy | 211/59.1 |
| 5,862,943 | A | * | 1/1999 | Larit | 221/131 |
| D405,689 | S | | 2/1999 | Moon | |
| D411,676 | S | | 6/1999 | Cantrell | |
| D413,189 | S | | 8/1999 | Conti | |
| D417,616 | S | | 12/1999 | Conway | |
| 6,050,425 | A | * | 4/2000 | Kappel et al. | 211/40 |
| D427,810 | S | | 7/2000 | Ali et al. | |
| 6,082,557 | A | * | 7/2000 | Leahy | 211/59.3 |
| 6,152,359 | A | | 11/2000 | Clark | |
| D436,312 | S | | 1/2001 | Denbraver | |
| D436,705 | S | | 1/2001 | Dow et al. | |
| 6,170,740 | B1 | | 1/2001 | Clark | |
| D437,698 | S | | 2/2001 | Cassler | |
| D439,279 | S | * | 3/2001 | McColskey et al. | D19/90 |
| D446,684 | S | | 8/2001 | Price | |
| 6,270,007 | B1 | * | 8/2001 | Jensen, Jr. | 229/122.21 |
| 6,293,405 | B1 | * | 9/2001 | Burch, Jr. | 206/767 |
| D450,456 | S | | 11/2001 | Warren, III | |
| 6,312,067 | B1 | * | 11/2001 | Blanchard et al. | 312/102 |
| D456,211 | S | | 4/2002 | Price | |
| 6,393,761 | B1 | | 5/2002 | Deacon | |
| D462,422 | S | | 9/2002 | Conner | |
| 6,453,605 | B1 | | 9/2002 | Chien | |
| D466,763 | S | | 12/2002 | Wu | |
| 6,594,953 | B2 | | 7/2003 | Weder et al. | |
| D489,501 | S | | 5/2004 | Dretzka | |
| 6,749,064 | B1 | * | 6/2004 | Alrey | 206/457 |
| D494,885 | S | | 8/2004 | Rahme | |
| D495,880 | S | | 9/2004 | Warren, III | |
| 6,817,481 | B2 | * | 11/2004 | Alexander | 220/476 |
| 6,883,671 | B2 | * | 4/2005 | Rushing | 211/88.01 |
| 6,929,131 | B1 | | 8/2005 | Landi | |
| D521,202 | S | | 5/2006 | Lin | |
| 7,066,321 | B2 | * | 6/2006 | Kawaguchi et al. | 206/77.1 |
| D525,657 | S | | 7/2006 | Warren, III | |
| 7,090,116 | B2 | | 8/2006 | Cutler et al. | |
| 7,111,735 | B2 | | 9/2006 | Lowry | |
| 7,159,721 | B2 | | 1/2007 | Martin, Jr. | |
| D536,497 | S | | 2/2007 | Chiang | |
| D546,631 | S | | 7/2007 | Carey | |
| D555,736 | S | * | 11/2007 | Decarlo et al. | D19/90 |
| 7,428,972 | B2 | | 9/2008 | Warner et al. | |
| 7,469,814 | B2 | * | 12/2008 | Philips | 229/120.11 |
| 7,478,745 | B2 | * | 1/2009 | Philips | 229/240 |
| 7,546,926 | B2 | | 6/2009 | Stolle et al. | |
| 7,584,854 | B2 | | 9/2009 | Chandaria | |
| 7,625,488 | B2 | | 12/2009 | Blackburn | |
| 7,665,617 | B2 | * | 2/2010 | Shea | 211/59.1 |
| D618,021 | S | | 6/2010 | Guindi | |
| D625,852 | S | | 10/2010 | Franklin | |
| D625,855 | S | | 10/2010 | Franklin | |
| D626,866 | S | | 11/2010 | Powers | |
| D631,512 | S | * | 1/2011 | Stravitz | D19/90 |
| D631,580 | S | | 1/2011 | Franklin | |
| D631,581 | S | | 1/2011 | Franklin | |
| D632,651 | S | | 2/2011 | Foreman et al. | |
| D638,644 | S | | 5/2011 | Tawil | |
| D645,779 | S | | 9/2011 | Bradley et al. | |

(56) References Cited

U.S. PATENT DOCUMENTS

| | | | | |
|---|---|---|---|---|
| D645,903 | S * | 9/2011 | Tsai | D19/90 |
| 8,016,131 | B2 | 9/2011 | Belokin et al. | |
| 8,042,700 | B1 * | 10/2011 | Smalley | 211/90.01 |
| 8,091,715 | B2 * | 1/2012 | Roth | 211/187 |
| D660,594 | S | 5/2012 | Hawkins | |
| D675,442 | S | 2/2013 | Hawkins | |
| D680,353 | S | 4/2013 | Hawkins | |
| 8,464,879 | B2 * | 6/2013 | Black et al. | 211/195 |
| D689,943 | S * | 9/2013 | Hu | D19/90 |
| D689,944 | S * | 9/2013 | Hu | D19/90 |
| 8,528,752 | B2 * | 9/2013 | Bowser et al. | 211/90.02 |
| 8,887,940 | B2 * | 11/2014 | Kiceniuk et al. | 220/495.02 |
| 8,915,381 | B2 * | 12/2014 | Brozak et al. | 211/60.1 |
| 2002/0157308 | A1 | 10/2002 | Hanis | |
| 2002/0185525 | A1 | 12/2002 | Hallam | |
| 2003/0168368 | A1 * | 9/2003 | Terrell et al. | 206/391 |
| 2004/0050811 | A1 * | 3/2004 | Leahy et al. | 211/134 |
| 2004/0217075 | A1 * | 11/2004 | Lackey et al. | 211/60.1 |
| 2005/0077207 | A1 * | 4/2005 | Hubbs et al. | 206/736 |
| 2005/0189308 | A1 * | 9/2005 | Warner et al. | 211/59.1 |
| 2006/0070911 | A1 * | 4/2006 | Lowry | 206/736 |
| 2006/0289609 | A1 | 12/2006 | Fritz et al. | |
| 2007/0090015 | A1 * | 4/2007 | Chandaria | 206/736 |
| 2007/0205167 | A1 * | 9/2007 | Belokin et al. | 211/75 |
| 2007/0295680 | A1 * | 12/2007 | Budge et al. | 211/85.18 |
| 2008/0017597 | A1 * | 1/2008 | Branch, III | 211/44 |
| 2009/0071919 | A1 * | 3/2009 | Blanchet et al. | 211/60.1 |
| 2009/0107936 | A1 * | 4/2009 | Scriba et al. | 211/88.01 |
| 2009/0124464 | A1 * | 5/2009 | Kastelic | 482/52 |
| 2009/0145953 | A1 | 6/2009 | Heinemann, III et al. | |
| 2009/0178988 | A1 * | 7/2009 | Lang | 211/88.01 |
| 2009/0200200 | A1 | 8/2009 | Trappani et al. | |
| 2010/0270246 | A1 | 10/2010 | Rodriguez | |
| 2010/0320262 | A1 | 12/2010 | Tao | |
| 2012/0012502 | A1 * | 1/2012 | Young | 206/736 |
| 2012/0012547 | A1 | 1/2012 | Bergdoll et al. | |
| 2012/0061289 | A1 * | 3/2012 | Langtry et al. | 206/736 |
| 2012/0073192 | A1 | 3/2012 | Tiers | |
| 2012/0085718 | A1 | 4/2012 | Bergdoll et al. | |
| 2012/0305508 | A1 | 12/2012 | Brozak et al. | |
| 2013/0026163 | A1 | 1/2013 | Hawkins | |
| 2013/0105355 | A1 * | 5/2013 | Keefe | 206/736 |
| 2013/0167435 | A1 | 7/2013 | Weder | |
| 2013/0277270 | A1 * | 10/2013 | Scatterday | 206/736 |
| 2014/0144808 | A1 * | 5/2014 | Anderson | 206/736 |

OTHER PUBLICATIONS

Office Action from Canadian Patent Application No. 2,839,574, mailed Nov. 7, 2014 (3 pages).

* cited by examiner

RETAIL FIXTURES

BACKGROUND

In retail stores, products are placed on display units to make it easier for customers to find and select the items they want. The display units must make it easy for customers to see the products, to determine the price of the products and to remove the products from the display units. Further, display units should entice customers to purchase items that they may not have planned on buying before entering the store.

The discussion above is merely provided for general background information and is not intended to be used as an aid in determining the scope of the claimed subject matter. The claimed subject matter is not limited to implementations that solve any or all disadvantages noted in the background.

SUMMARY

A display fixture has a bin with multiple sections. A clip attached to a back panel of the bin has an aperture for receiving a fastener to fasten the bin to a peg board. A back support is mounted to the bin and has a downwardly extending leg that is sized to fit between the peg board and a back surface of a base that the display fixture is seated upon.

In further embodiments, a display fixture is provided that includes a lower tier of product sections and an upper tier of product sections. The lower tier of product sections is defined in part by a front panel and has a lower sign support with two legs attached to the front panel and a lower label holder connected between the two legs such that there is an open space defined between the two legs and between a top of the front panel and a bottom of the lower label holder. The upper tier of product sections is defined in part by a front panel and has an upper sign support with two legs attached to the front panel of the upper tier of product sections and an upper label holder connected between the two legs such that there is an open space defined between the two legs and between a top of the front panel of the upper tier of product sections and a bottom of the upper label holder.

In further embodiments, a display system has a wrapping paper holder and a ribbon tray mounted to a display unit. The wrapping paper holder has at least one front section that contains tubes of wrapping paper and at least one back section that contains tubes of wrapping paper. The ribbon tray is mounted to the display unit above the wrapping paper holder such that the ribbon tray extends from a back wall of the display unit over a top of at least part of a tube of wrapping paper in the back section of the wrapping paper holder at a height from the top of the tube of wrapping paper that is less than a height of the tube of wrapping paper in the back section.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Wrapping paper is challenging to display because it comes on rolls and sales are dependent on the customers being able to see as much of the pattern of the wrapping paper as possible while also being able to identify the price of a particular roll of wrapping paper quickly. In addition, there are large numbers of different patterns of wrapping paper that are made available during various times of the year and the various patterns need to be kept separate from each other so that the consumer can quickly discern the available patterns in the store. In addition, consumers often neglect to buy ribbon for wrapping paper because the ribbon is often displayed separately from the wrapping paper. As with wrapping paper, ribbon is a challenge to display since it often comes on rolls and since there are a large number of available sizes and colors of ribbon. Thus, displaying ribbon near wrapping paper so that the available ribbon can be seen and the price of each available ribbon can be quickly identified by the customer is challenging.

Embodiments described below provide a display system that allows tubes of wrapping paper to be displayed so that customers can see the available patterns of wrapping paper and so that customers can quickly identify the prices of different groups of wrapping paper. The system also provides easy access to both wrapping paper and ribbon while presenting the ribbon in close proximity to the wrapping paper so that customers are reminded to purchase ribbon when purchasing wrapping paper.

Figure 1:
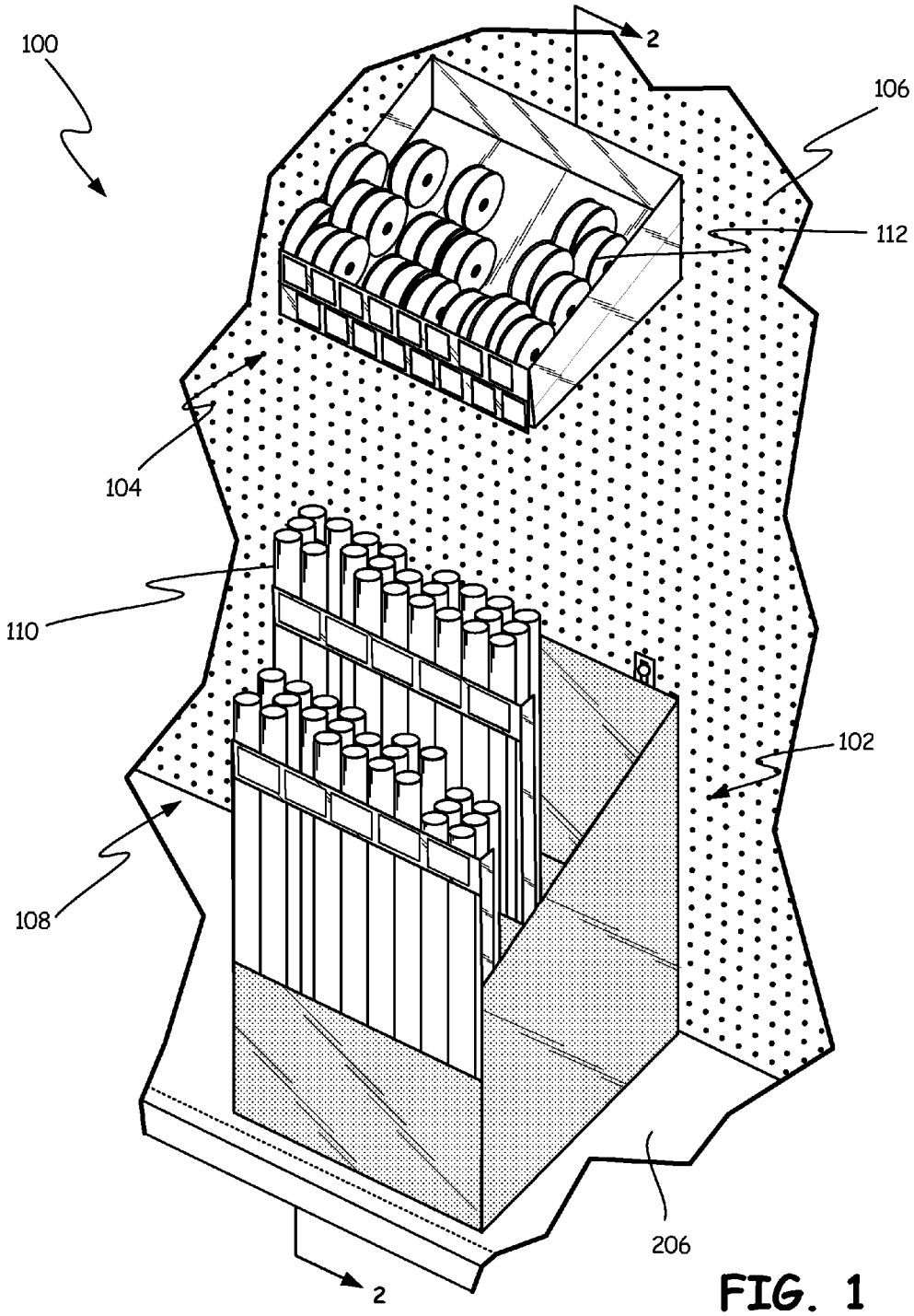
FIG. 1 is a perspective view of a display system.

FIG. 1 provides a perspective view of a display system 100. In display system 100, a display fixture/display unit/wrapping paper holder 102 and a ribbon tray/display fixture 104 are mounted on a display unit 108 that includes a pegboard back wall 106 and a base 206. Tubes of wrapping paper 110 are positioned in and organized by wrapping paper holder 102 while rolls of ribbon 112 are positioned in and organized by ribbon tray 104.

Figure 2:
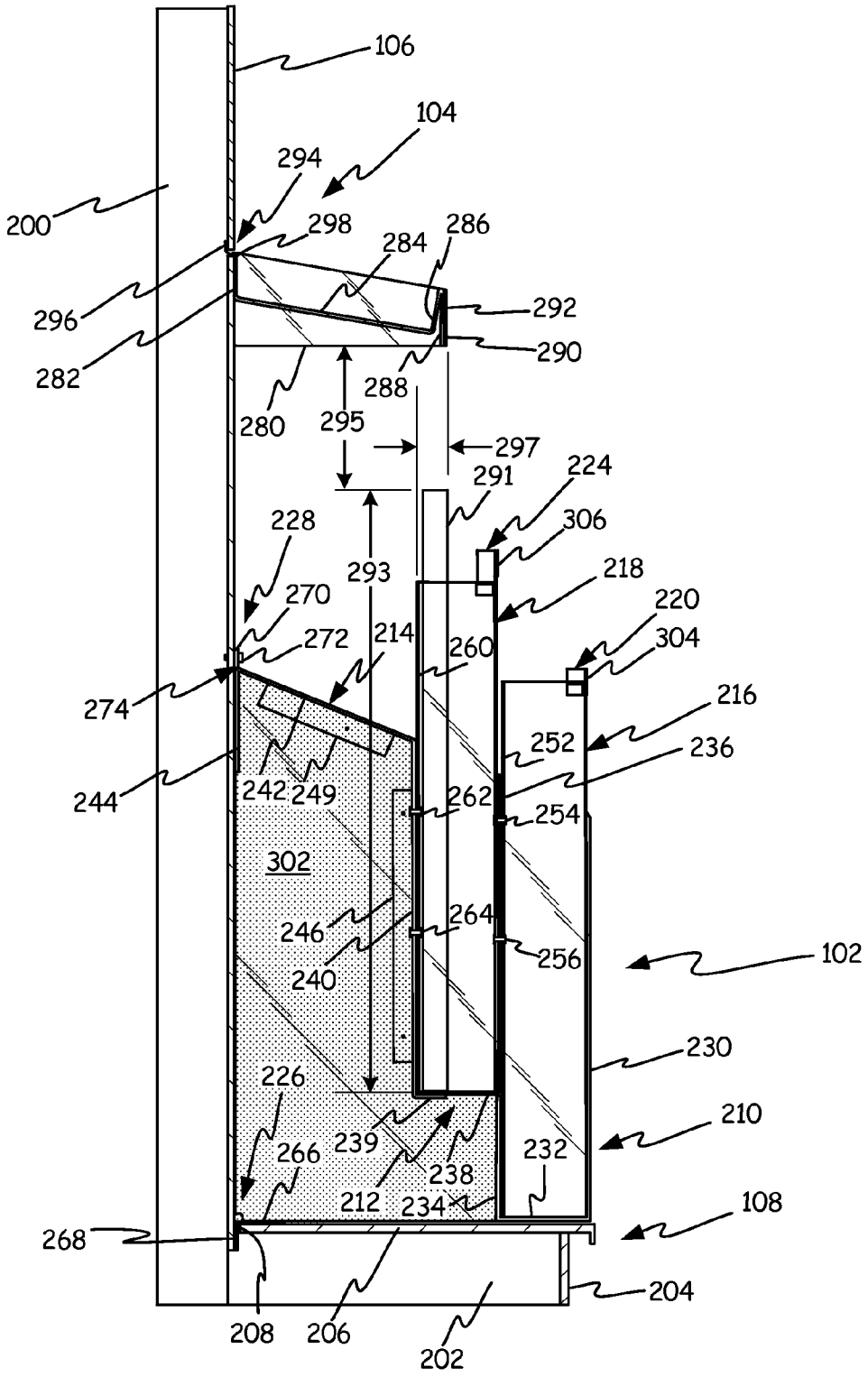
FIG. 2 is a section view of the display system of FIG. 1.

FIG. 2 provides a section view of display system 100 along line 2-2 of the perspective view of FIG. 1. In FIG. 2, the display ribbons and most of the tubes of wrapping paper have been removed for clarity.

As shown in FIG. 2, display unit 108 includes vertical support 200 which supports pegboard/back wall 106. Display unit 108 also includes base 206 that is supported by a side 202 and by toe kick 204. Base 206 has a back surface 208 facing pegboard 106. Pegboard 106 includes an assortment of through holes (not shown for clarity), which in some embodiments are arranged in rows and columns. Wrapping paper holder 102 is seated upon a top surface of base 206.

In FIG. 2, portions of wrapping paper holder 102 are depicted that include three internal support structures 210, 212 and 214, two dividers 216 and 218, a lower sign support 220, an upper sign support 224, a back support/bottom bracket 226, and an attachment assembly 228.

Internal structure 210 includes a front wall or front panel 230, a lower tier floor 232 and a lower back wall 234. In accordance with one embodiment, internal structure 210 is made from a single sheet of plastic material having two folds therein such that front wall 230 is orthogonal to lower tier floor 232 and back wall 234 is orthogonal to lower tier floor 232. Internal structure 212 includes a front wall 236 and an upper tier floor 238. In accordance with one embodiment, internal structure 212 is made of a single piece of plastic that has been bent such that front wall 236 is orthogonal to upper tier floor 238. Internal structure 214 includes a lower support 239, a back wall 240, an angled top 242 and a back panel 244. In addition, internal structure 214 includes support tabs 246 and 248 which connect to a side panel 302. Internal structure 214 is preferably a single sheet of plastic material that is bent at substantially 90° between bottom support 239 and back panel 240, is bent at an angle of substantially 112° between back panel 240 and angled top 242, and is bent at an angle of substantially 68° between angled top panel 242 and back panel 244. In accordance with one embodiment, each of internal structures 210, 212 and 214 and side panel 302 are made of clear or partially clear polyethylene terephthalate glycol (PETG).

Upper tier floor 238 is positioned above lower tier floor 232 such that wrapping paper tubes supported by upper tier floor 238 will extend above wrapping paper tubes supported by lower tier floor 232.

Divider 216 includes a center panel 252 that is fastened to front wall 236 by fasteners 254 and 256. Divider 218 includes a center panel 260 that is fastened to back wall 240 of internal structure 214 by fasteners 262 and 264.

Back support/bottom bracket 226 includes a horizontal leg 266 and a downwardly extending leg 268, which in one embodiment is substantially orthogonal to horizontal leg 266. Horizontal leg 266 is attached to side 302 and side 300 (FIG. 3) along bottom portions of sides 302 and 304 that are folded inward toward each other substantially orthogonal to the vertical portions of sides 302 and 300. Downwardly extending leg 268 extends downwardly between back surface 208 of base 206 and a front surface of pegboard 106. Downwardly extending leg 268 thereby prevents the bottom of wrapping paper holder 102 from shifting away from pegboard 106.

Figure 3:
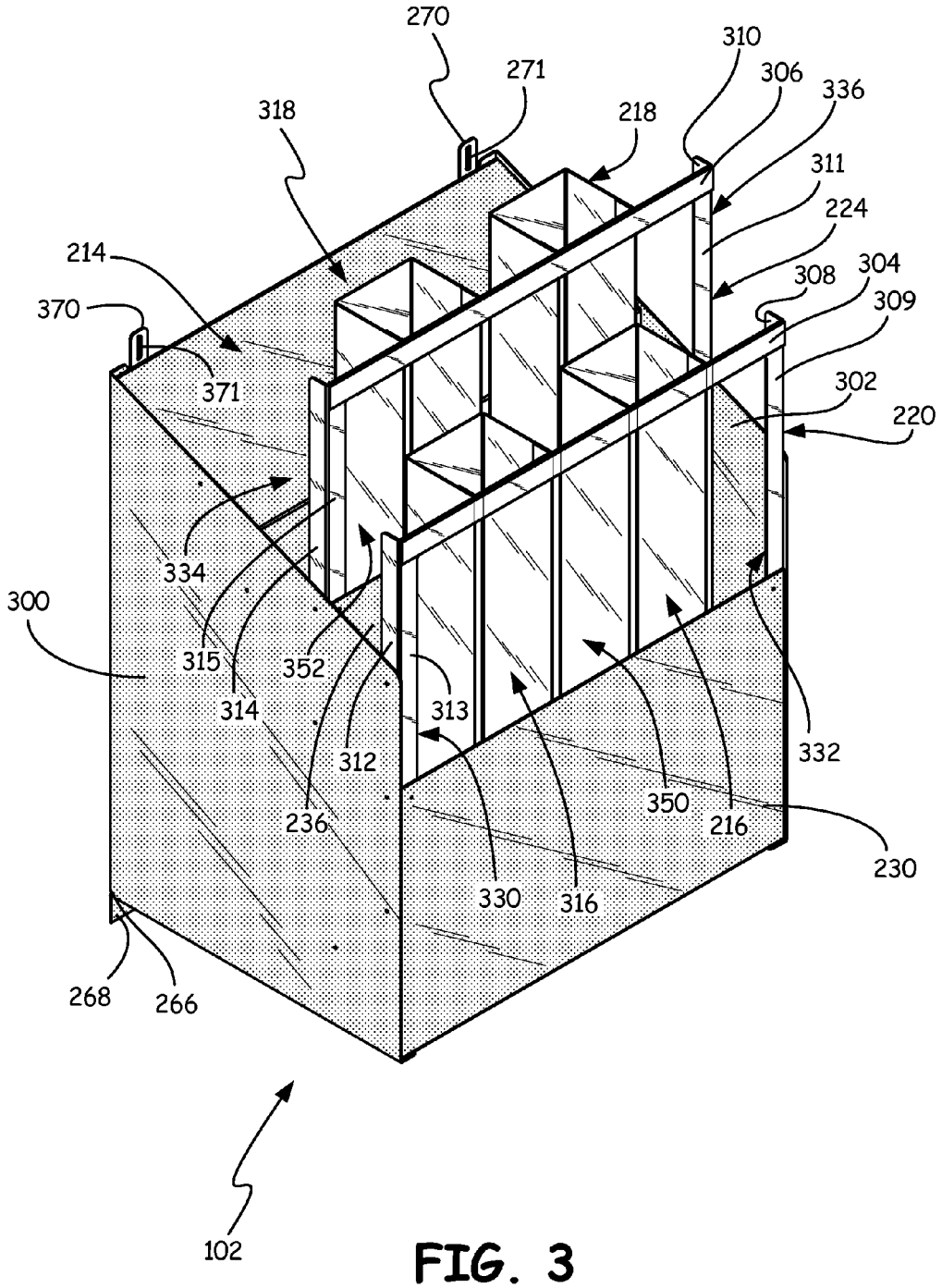
FIG. 3 is a perspective view of a wrapping paper holder.

Fastening mechanism 228 includes a clip 270 extending from a top 274 of back panel 244. Clip 270 includes an aperture 271 (FIG. 3). A fastener 272 passes through aperture 271 and a hole in pegboard 106 in order to fasten clip 270 to pegboard 106.

Figure 9:
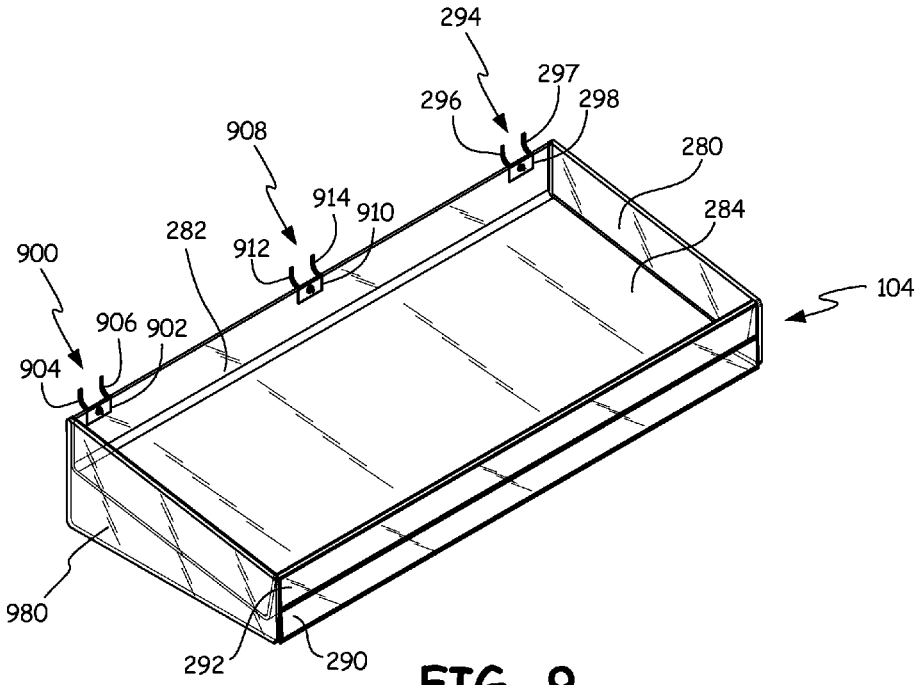
FIG. 9 is a perspective view of a ribbon tray.

Ribbon tray 104 includes a back wall 282, bottom surface 284, front wall 286, label support wall 288, label holders 290 and 292, side walls 280 and 980 (FIG. 9) and mounting mechanisms 294, 900 (FIG. 9) and 908 (FIG. 9). Mounting mechanism 294 has an attachment base 298 attached to back wall 282 and a hook 296 extending from attachment base 298. Hook 296 passes through a hole in pegboard 106 and in combination with back wall 282 and back surfaces of side walls 280 and 980, supports ribbon tray 104 on pegboard 106. Label holders 290 and 292 are supported on label support wall 288. For example, label holder are supported by adhesive in accordance with one embodiment.

As shown in FIG. 2, ribbon display tray 104 extends from pegboard 106 over wrapping paper holder 102 such that ribbon display tray 104 extends over the top of at least part of the top of a wrapping paper tube such as wrapping paper tube 291. In particular, ribbon display tray 104 extends a distance 297 past a front surface of back wall 240 of wrapping paper holder 102. In addition, ribbon display tray 104 is located a height 295 above the top of wrapping paper tube 291 which is smaller than a height 293 of wrapping paper tube 291. Note that because of the short distance in height between the top of the wrapping paper tube and the bottom of display tray 104, if display tray 104 extended further out from pegboard 106, it would not be possible to remove the tubes of wrapping paper from wrapping paper holder 102. Further, if ribbon display tray 104 were mounted higher on pegboard 106, consumers would not be able to reach the ribbon in ribbon display tray 104 as easily or would not be able to see the ribbon as clearly. Thus, by extending display ribbon tray 104 over a portion of but not all of wrapping paper holder 102, it is possible to position ribbon display tray 104 lower to provide access to ribbon display tray 104 without interfering with the customer's ability to remove wrapping paper from wrapping paper holder 102.

Figure 4:
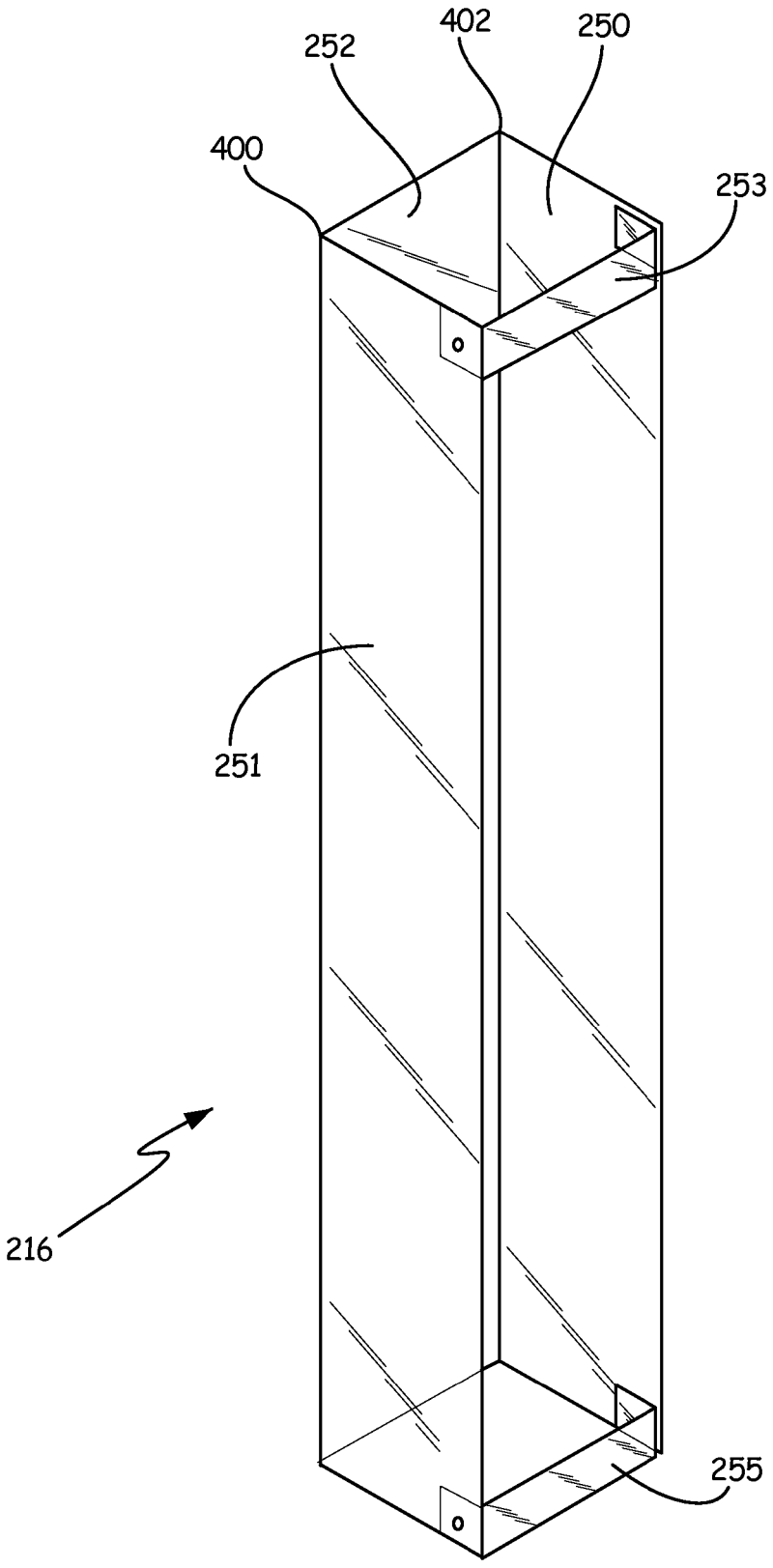
FIG. 4 is a perspective view of a three-sided divider.
Figure 5:
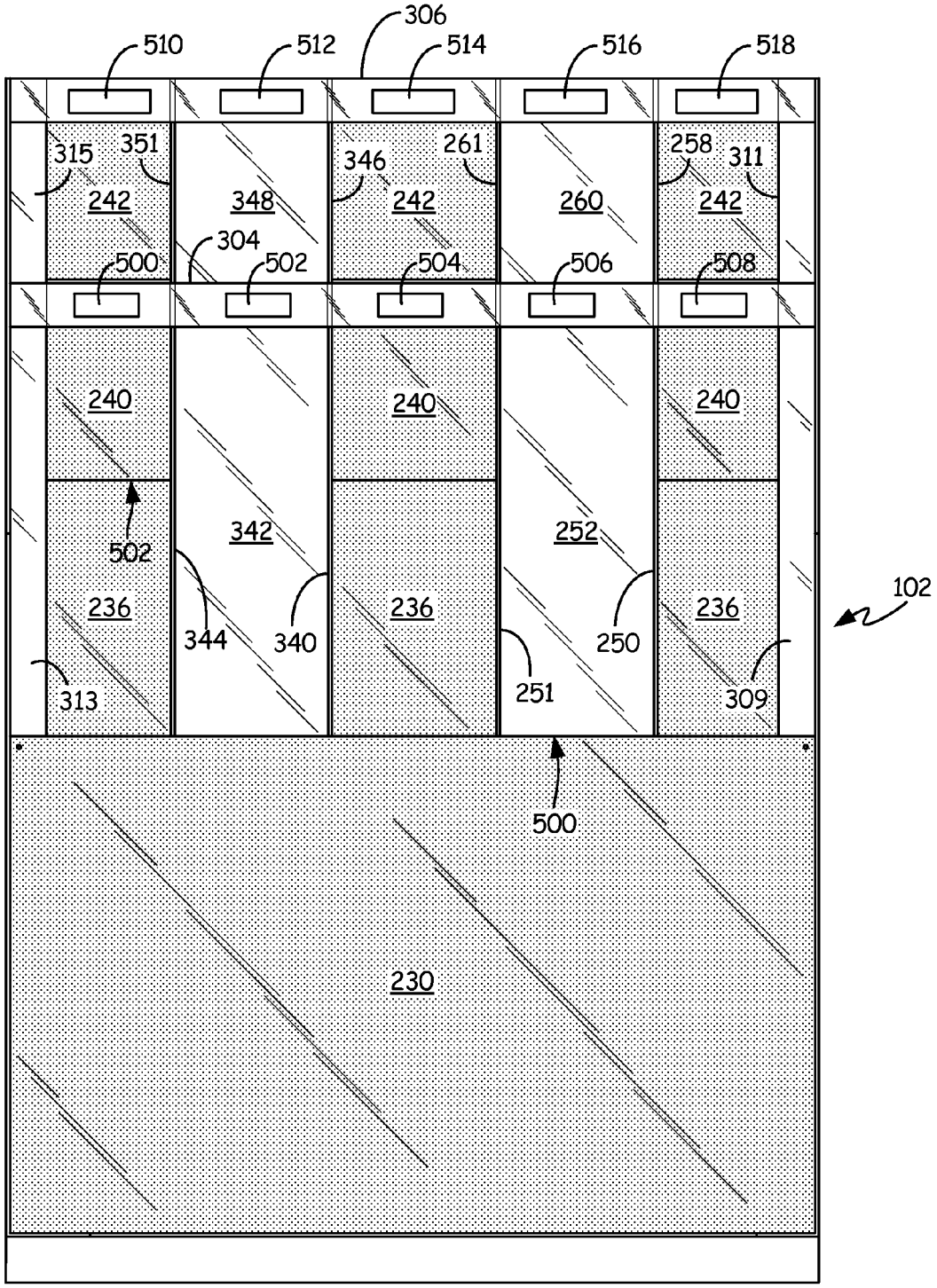
FIG. 5 is a front view of the wrapping paper holder of FIG. 3.
Figure 6:
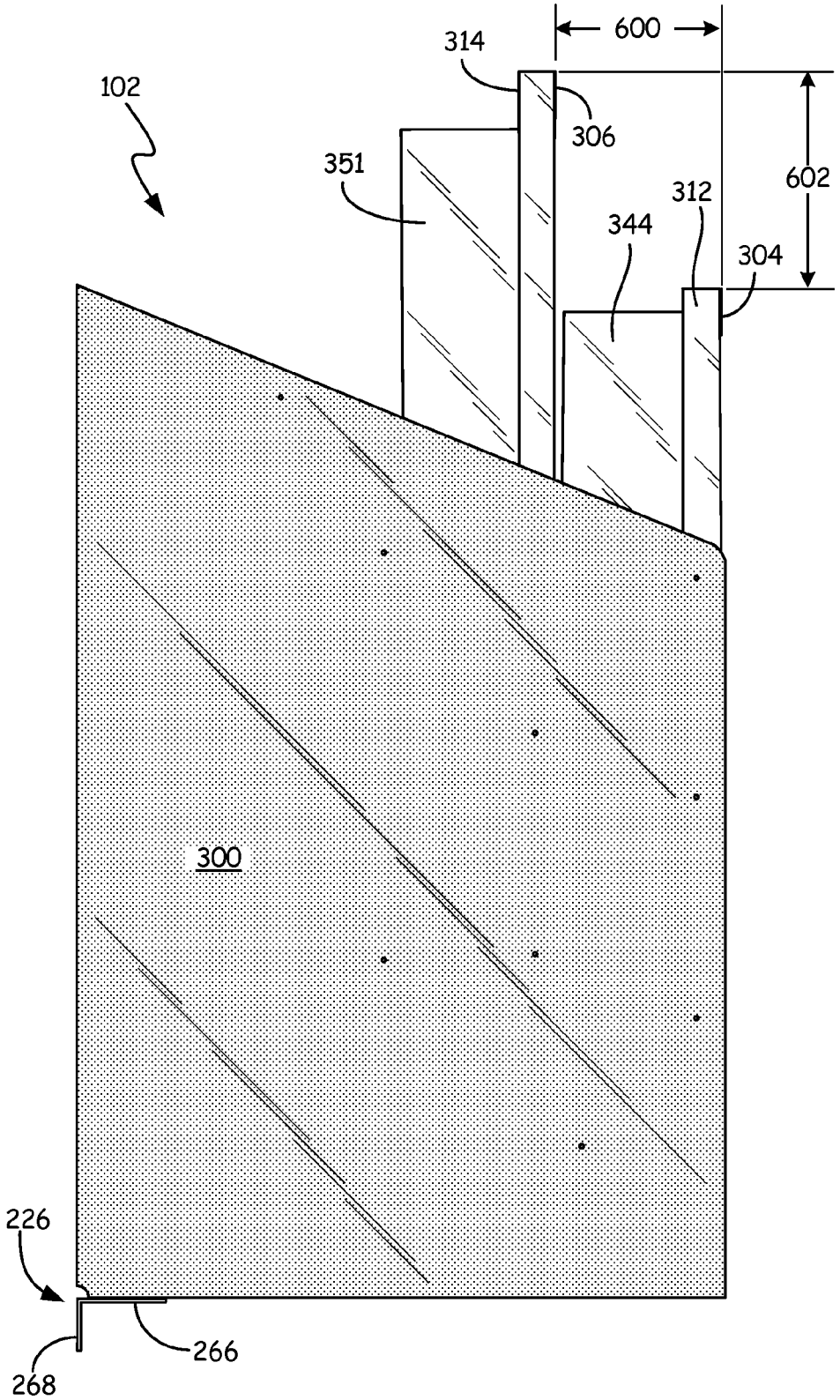
FIG. 6 is a left side view of the wrapping paper holder of FIG. 3.
Figure 7:
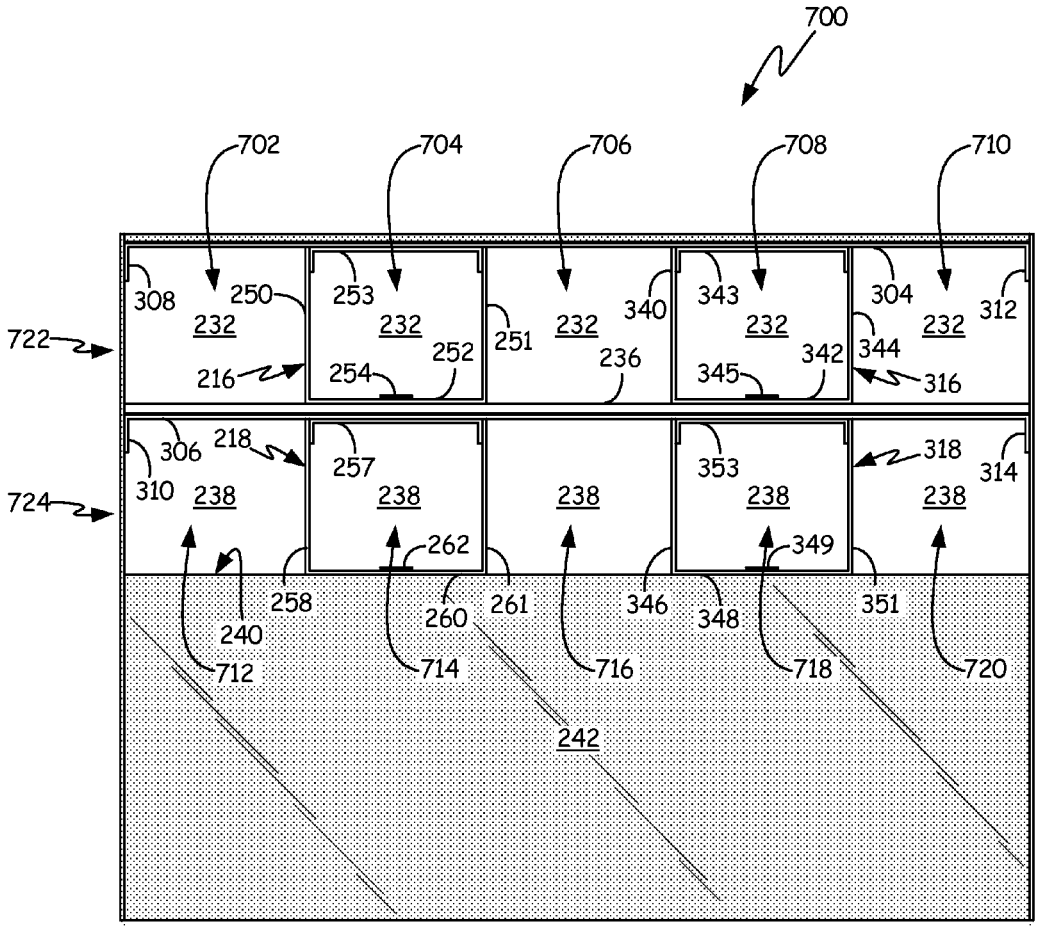
FIG. 7 is a top view of the wrapping paper holder of FIG. 3.

FIG. 3 provides a perspective view of wrapping holder 102, FIG. 5 provides a front view thereof, FIG. 6 provides a left side view of thereof, the right side view being a mirror image, and FIG. 7 provides a top view thereof. The back views of wrapping paper holder 102 and the bottom view of wrapping paper holder 102 are not shown because they are unadorned and are unnecessary to an understanding of the invention. FIG. 4 provides a perspective view of a divider.

As shown in the perspective view of FIG. 3, wrapping paper holder 102 includes a second fastening mechanism consisting of a clip 370 with an aperture 371. In addition, lower sign support 220 and upper sign support 224 are shown in FIG. 3 as including additional structural elements. Lower sign support 220 includes two legs 330 and 332 and a label holder 304. Leg 332 extends between front panel 230 and label holder 304 and includes a side wall 308 and a front wall 309. Front wall 309 is connected to front panel 230 and side wall 308 is connected to side panel 302. Leg 330 extends from front panel 230 to label holder 304 and includes a front wall 313 and a side wall 312. Side wall 312 is connected to side wall 300 and front wall 313 is connected to front panel 230. Label holder 304 is attached to the tops of legs 330 and 332 and extends between legs 330 and 332. Lower sign support 220 is structured such that a space 350 is present between an upper surface of front panel 230 and a lower surface of label holder 304 and between an edge of leg 330 and an edge of leg 332. This space provides a viewing area where wrapping paper held in the lower tier of wrapping paper holder 102 can be viewed.

Upper sign support 224 includes leg 336, leg 334, and label holder 306. Leg 334 includes a side wall 314 and a front wall 315 where side wall 314 is attached to side wall 300 and front wall 315 is attached to front wall 236. Leg 336 includes a front wall 311 and a side wall 310 with side wall 310 attached to side wall 302 and front wall 311 attached to front wall 236. Label holder 306 is attached to the top of legs 334 and 336 and extends between legs 334 and 336. The structure of upper sign support 224 is such that label holder 306 is above and separated from a top of front wall 236 so that a space 352 is open between label holder 306 and front wall 236 and between an edge of leg 334 and an edge of leg 336.

As shown in FIG. 3, wrapping paper holder 102 includes four divider structures 216, 218, 316 and 318, which in accordance with some embodiments are substantially clear. In one particular embodiment, each of divider structures 216, 218, 316 and 318 are made from clear PETG. FIG. 4 provides a perspective view of clear divider structure 216. The structure of divider 216 is the same as the structure of dividers 218, 316 and 318.

Divider structure 216, also referred to as a three sided divider or a three panel divider includes a center portion/center panel/part 252 and two side portions/side panels 250 and 251 on opposing sides of center portion 252 and extending from folds 402 and 400, respectively, between center portion 252 and side portions 250 and 251. In accordance with one embodiment, folds 400 and 402 are such that side portions 250 and 251 are substantially orthogonal to center portion 252. The fronts of side portions 250 and 251 are connected together by two strips 253 and 255. Strips 253 and 255 connect side portions 250 and 251 along less than the entirety of those side portions. By connecting the side portions along less than the entirety of the side portions, strips 253 and 255 do not obscure the view of the wrapping paper held between side portions 250 and 251.

As shown more clearly in FIG. 5, label holder 304 is above and separate from a top surface 500 of front wall 230 and label holder 306 is above and separate from a top surface 502 of front wall 236. Label holders 304 and 306 contain labels that provide pricing information such as the price, size and name of the wrapping paper held in each section of wrapping paper holder 102. For example, labels 500, 502, 504, 506 and 508 are in label holder 304 and labels 510, 512, 514, 516 and 518 are in label holder 306.

As shown in FIG. 6, label holder 306 is vertically offset from label holder 304 by vertical offset distance 602 and is horizontally offset from label holder 304 by a horizontal offset distance 600. Horizontal offset distance 600 provides room in front of label holder 306 to place tubes of wrapping paper in the lower tier of wrapping paper holder 102.

As shown in FIG. 7, wrapping paper holder 102 includes rows or sets of sections including row 722 also referred to as a lower tier of product sections or a front row of sections and row 724 also referred to as an upper tier of product sections or back row of sections. Front row of sections 722 includes front sections 702, 704, 706, 708 and 710 which are defined by dividers 216 and 316. Divider 216 consists of center portion 252 and side portions 250 and 251, which are connected together by strip 253. Divider 316 consists of center portion 342, side portions 340 and 344 and connecting strip 343. Side walls 250, 251, 340 and 344 separate front sections 702, 704, 706, 708 and 710 from each other. Center portions 252 and 342 of dividers 216 and 316, respectively, are mounted to front wall 236 by fasteners 254 and 345, respectively. Front wall 236 forms a back of sections 702, 704, 706, 708 and 710. Front sections 702, 704, 706, 708 and 710 are behind front label holder 304 and in front of back label holder 306.

Back row or upper tier of product sections 724 includes back sections 712, 714, 716, 718 and 720, which are defined by dividers 218 and 318. Divider 218 includes center portion 260, opposing side portions 258 and 261, and connecting strip 257. Center portion 260 is mounted to back wall 240 by fastener 262. Divider 318 consists of center portion 348, opposing side portions 346 and 351, and connecting strip 353. Center portion 348 is mounted to back wall 240 by fastener 349. Side walls 258, 261, 346 and 351 divide the upper tier into back sections 712, 714, 716, 718 and 722.

Figure 8:
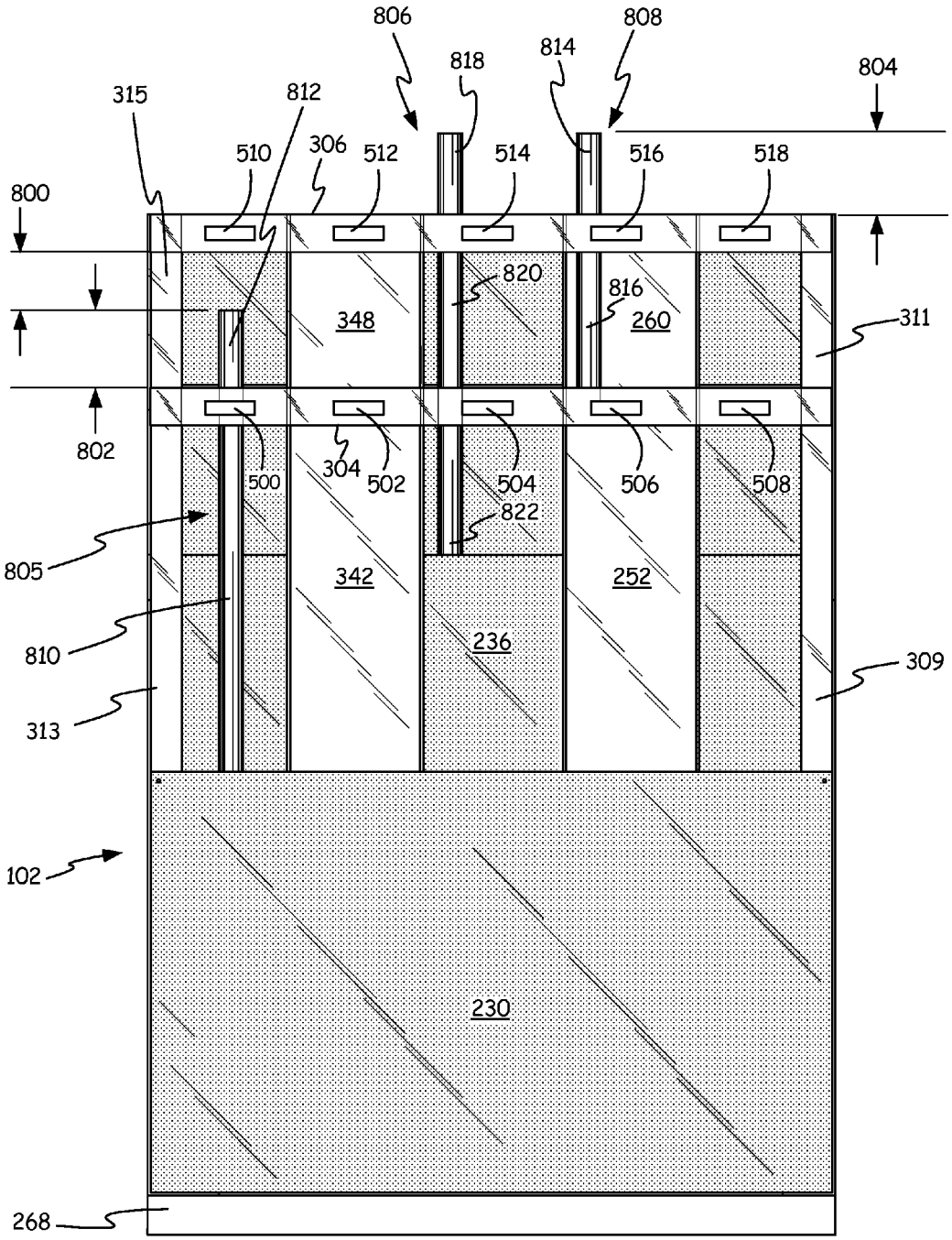
FIG. 8 is a front view of a wrapping paper holder showing wrapping paper held therein.

FIG. 8 shows a front view of wrapping paper holder 102 with tubes of wrapping paper 805, 806 and 808. Tube 805 is positioned in front section 710, tube 806 is positioned in back section 716 and tube 808 is positioned in back section 714. Tube 805 has a top portion 812 that extends above label holder 304 by a distance 802 and the top of tube 805 is below label holder 306 by a distance 800. Thus, the vertical offset between label holder 304 and 306 is enough to avoid having label holder 306 obscured by tubes of wrapping paper such as tube 805 in one of the front sections. Tubes 806 and 808 have top portions 818 and 814, respectively, that extend a distance 804 over the top of label holder 306. Distances 802 and 804 provide enough room to accommodate a person's hand so that a person may easily grab a tube of wrapping paper. Thus, a customer does not have to reach down behind label holders 304 and 306 in order to firmly grab a tube of wrapping paper with the entirety of their hands.

Wrapping paper tube 805 also includes an exposed area 810 that is exposed between label holder 304 and front 230. Wrapping paper tube 806 includes two exposed areas 820 and 822. Exposed area 822 is between label holder 304 and front wall 236. Exposed area 820 is between label holder 306 and label holder 304. Tube of wrapping paper 808 includes an exposed area 816 between label holder 306 and label holder 304. Tube of wrapping paper 808 is not exposed below label holder 304 because it is blocked by center portion 252 of divider 216. Exposed areas 810, 816, 820 and 822 provide the customer with a better view of the pattern of the wrapping paper and thus make it easier for a customer to make a choice about which wrapping paper to purchase.

Sections 702, 704, 706, 708, 710, 712, 714, 716, 718 and 720 allow wrapping paper to be grouped together based on the pattern of the wrapping paper. By organizing the wrapping paper based on its patterns, wrapping paper holder 102 makes it easier for consumers to identify all of the available patterns for sale and thus makes it easier for a consumer to make a choice of which wrapping paper to purchase. Further, since each section has a corresponding price label 500, 502, 504, 506, 508 510, 512, 514, 516, and 518 that is positioned immediately in front of the section near where the customer will grab wrapping paper, information about the wrapping paper in each section, such as pricing and size information, is easily determined by the customer so that the customer can make an informed decision about which wrapping paper to purchase.

Figure 10:
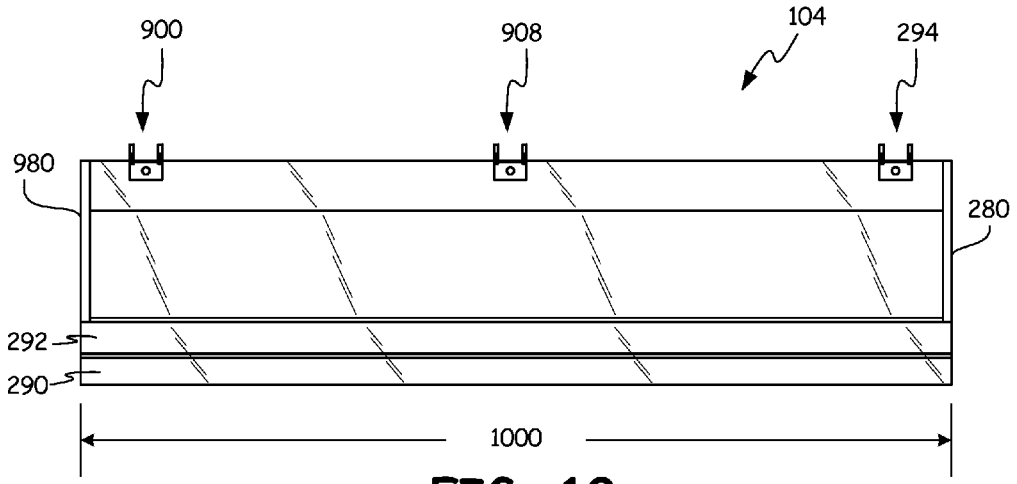
FIG. 10 is a front view of the ribbon tray of FIG. 9.
Figure 11:
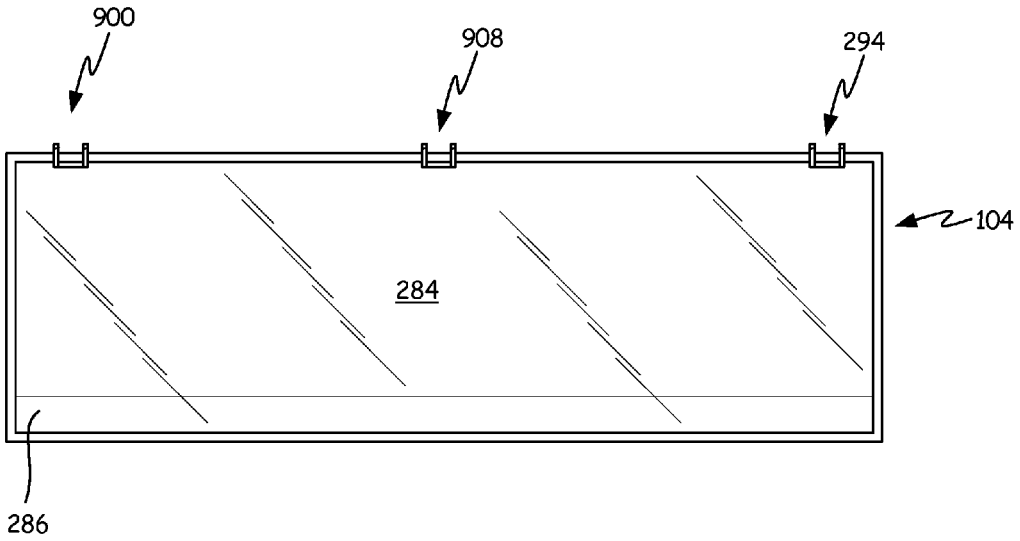
FIG. 11 is a top view of the ribbon tray of FIG. 9.
Figure 12:
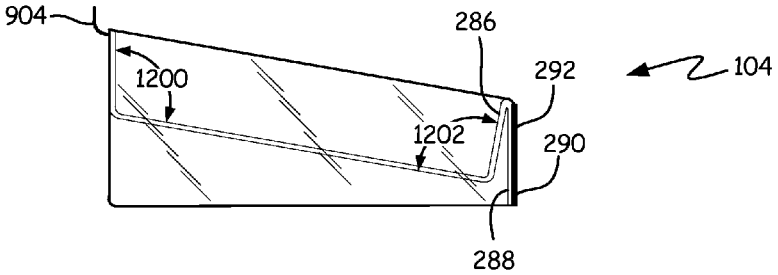
FIG. 12 is a left side view of the ribbon tray of FIG. 9.

FIG. 9 provides a perspective view of ribbon display tray 104, FIG. 10 provides a front view thereof, FIG. 11 provides a top view thereof and FIG. 12 provides a left side view thereof, the right side view being a minor image. The back view and the bottom view are not provided because they are unadorned and unnecessary to an understanding of the invention.

Ribbon display tray 104 includes back wall 282, bottom surface 284, front wall 286, label support wall 288, label holders 290 and 292, side walls 280 and 980 and mounting mechanisms 294, 900 and 908. Mounting mechanism 294 includes a mounting base 298 that is mounted to back wall 282 and two hooks 296 and 297 designed to be placed in respective holes in pegboard 106. Similarly, mounting mechanisms 900 and 908 include mounting bases 902 and 910, respectively, and hooks 904, 906, 912 and 914. In accordance with one embodiment, label holders 290 and 292 are mounted on label support wall 288 through adhesive tape. In accordance with one embodiment, back wall 282, bottom surface 284, front wall 286, label support wall 288 and side walls 280 and 980 are constructed from clear or substantially clear PETG.

Back wall 282 is at an angle 1200 (FIG. 12) to bottom surface 284, wherein angle 1200 is substantially 100° in one embodiment. Front wall 286 is at an angle 1202 to bottom surface 284. In accordance with some embodiments, angle 1202 is substantially 90°. Thus, bottom surface 284 slants downward when ribbon display tray 104 is mounted on pegboard 106 allowing rolls of ribbon supported on bottom surface 284 to roll forward to front wall 286, thereby making it easier for customers to remove ribbon from display tray 104.

Figure 13:
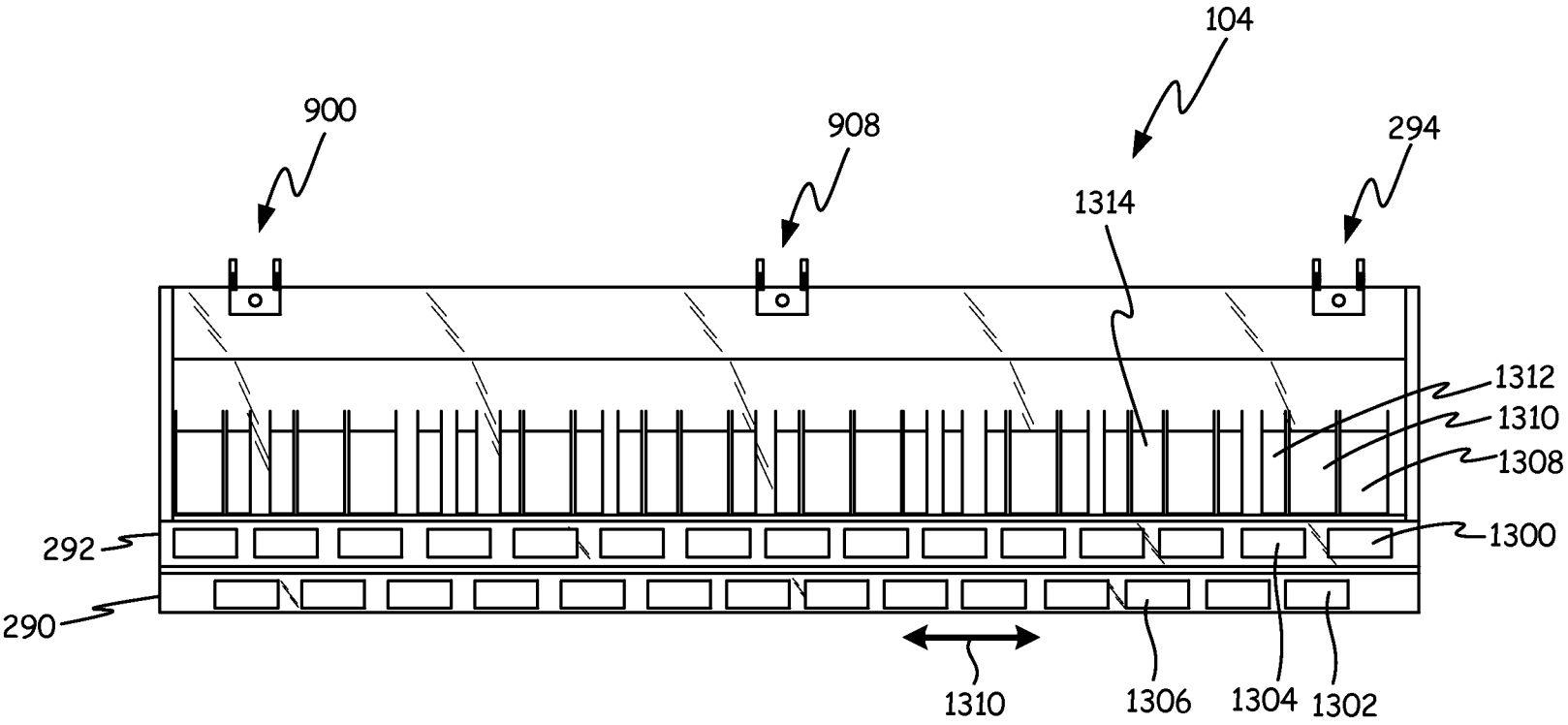
FIG. 13 is a front view of a ribbon tray having rolls of ribbon stored therein.

Label holders 290 and 292 are mounted such that label holder 292 is above label holder 290 and both label holder 290 and label holder 292 extend substantially the entire width 1000 of ribbon display tray 104. As shown in FIG. 13, each label holder 290 and 292 contains a plurality of labels such as labels 1300 and 1304 in label holder 292 and labels 1302 and 1306 in label holder 290. As shown in FIG. 13, the labels in label holder 290 are horizontally offset along horizontal axis 1310 from labels 1300 and 1304 of label holder 292. By utilizing this horizontal offset, it is possible to provide more labels for the ribbon in ribbon display tray 104. For example, label 1300 can be for ribbon 1308, label 1302 can be for ribbon 1310, label 1304 can be for ribbon 1312 and label 1306 can be for ribbon 1314. By utilizing the horizontal offset of the labels in the two label holders, a wider variety of ribbon can be placed in ribbon display tray 104 while still providing different labeling for each of variety of ribbon.

Although elements have been shown or described as separate embodiments above, portions of each embodiment may be combined with all or part of other embodiments described above.

Although elements have been shown in solid lines, one or more of elements may be removed within the scope of the present invention. In particular, one or more of the dividers, the label holder, the labels, the clips, the mounting mechanisms, and/or the bottom bracket may be removed within the scope of the present invention.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display unit comprising:

a lower tier of product sections defined in part by a front panel and having a lower sign support with two legs attached to the front panel and a lower label holder connected between the two legs such that there is an open space defined between the two legs and between a top of the front panel and a bottom of the lower label holder;

an upper tier of product sections defined in part by a front panel and having an upper sign support with two legs attached to the front panel of the upper tier of product sections and an upper label holder connected between the two legs such that there is an open space defined between the two legs and between a top of the front panel of the upper tier of product sections and a bottom of the upper label holder; and at least one first divider structure located in the lower tier of product sections between the front panel of the lower tier and the front panel of the upper tier and made of a single, continuous piece of material having three parts including a center part and two side parts folded relative to the center part to oppose each other and including front edges that define an open front, wherein the center part is attached to the front panel of the upper tier, the side parts divide the lower tier into at least three sections, a lower portion of the front edges abut the front panel of the lower tier and an upper portion of the front edges abut the lower label holder; and wherein the front edges that define the open front are connected together with a bottom strip proximate a bottom of the at least one first divider and a top strip proximate a top of the at least one first divider, the bottom strip is spaced apart from the top strip and is completely hidden behind the front panel of the lower tier and the top strip is completely hidden behind the lower label holder.

2. The display unit of claim 1 wherein the front panel of the upper tier of product sections defines a back of the lower tier of product sections.

3. The display unit of claim 1 further comprising a support attached to the display unit and having a leg extending downward from a bottom of the display unit.

4. The display unit of claim 1 further comprising at least one second divider structure made of a single, continuous piece of material having three parts including a center part and two side parts folded relative to the center part to oppose each other and including front edges that define an open front, wherein the center part of the at least one second divider structure is attached to a back wall of the upper tier, the side parts of the at least one second divider structure divide the upper tier into at least three sections, a lower portion of the front edges of the at least one second divider structure abut the front panel of the upper tier and an upper portion of the front edges of the at least one second divider structure abut the upper label holder.

5. A display unit comprising:

a front section defined by a front wall and a floor, wherein the front section includes a pair of legs attached to an inside surface of the front wall and extending above a top of the front wall to free ends and a front label holder connected between the free ends of the pair of legs so there is an open space between the top of the front wall and a bottom of the front label holder; and a back section defined by a front wall that also defines a portion of a back of the front section, a back wall and a floor, wherein the back section includes a pair of legs attached to an inside surface of the front wall of the back section and extending above a top of the front wall of the back section to free ends and a back label holder connected between the free ends of the pair of legs of the back section so there is an open space between the top of the front panel of the back section and a bottom of the back label holder;

wherein the front section comprises at least one clear divider made of a single, continuous piece of clear material having a first panel attached to the front wall of the back section, second and third panels folded relative to the first panel and facing each other to divide the front section into at least three bins and front edges that define an open front, the at least one clear divider of the front section extends from the floor of the front section, above the top edge of the front wall of the front section and terminates behind the front label holder between the bottom of the front label holder and a top of the front label holder and the front edges of the at least one clear divider of the front section abut the front wall of the front section and the front label holder;

wherein the floor of the back section is located above the floor of the front section and wherein the back label holder is located above the front label holder.

6. The display unit of claim 5 wherein the back section comprises at least one clear divider made of a single, continuous piece of clear material having first panel attached to the back wall of the back section and a second panel folded relative to the first panel that divides the back section into at least two bins.

7. The display unit of claim 6 wherein the at least one clear divider of the back section extends from the floor of the back section, above the top edge of the front wall of the back section and terminates behind the back label holder between the bottom of the back label holder and a top of the back label holder.

8. The display unit of claim 6 wherein the at least one clear divider of the back section further comprises a third panel so that the second panel and the third panel divide the back section into at least three bins.

9. The display unit of claim 5, wherein the front edges of the second and third panel of the at least one clear divider of the front section comprises are fastened together by at least one strip.

10. The display unit of claim 5, wherein the back section comprises at least one clear divider having a center panel that is fastened to the back wall of the back section and first and second side panels located on opposing sides of the center panel and the fronts of the first and second side panels being fastened together by at least one strip.

11. A wrapping holder display comprising:

a lower tier defined by a front panel and a floor, wherein attached to an inside surface of the front panel includes a pair of legs extending above a top of the front panel to free ends and a lower tier label holder connected between the free ends of the pair of legs so there is an open space between the top of the front panel and a bottom of the lower tier label holder;

an upper tier defined by a front panel that also defines a portion of a back of the lower tier, a back panel and a floor; wherein attached to an inside surface of the upper tier includes a pair of legs extending above a top of the front panel of the upper tier to free ends and an upper tier label holder connected between the free ends of the pair of legs of the upper tier so there is an open space between the top of the front panel of the upper tier and a bottom of the upper tier label holder;

at least one divider located in the lower tier to divide the lower tier into bins for holding elongated merchandise, wherein the at least one divider located in the lower tier is made of a single, continuous material having a bottom edge, a top edge, a pair of front edges, a center panel, two side panels folded relative to the center panel and an open front, wherein the divider located in the lower tier longitudinally extends from the bottom edge located on the floor of the lower tier to the top edge that terminates between the bottom of the lower tier label holder and a top of the lower tier label holder and the divider located in the lower tier laterally extends from the center panel coupled to the front panel of the upper tier to the pair of front edges located adjacent to and behind the lower tier label holder; and at least one divider located in the upper tier to divide the upper tier into bins for holding elongated merchandise, wherein the at least one divider located in the upper tier is made of a single, continuous material having a bottom edge, a top edge, a pair of front edges, a center panel, two side panels folded relative to the center panel and an open front, wherein the divider located in the upper tier extends from the bottom edge located on the floor of the upper tier to the top edge that terminates between the bottom of the upper tier label holder and a top of the upper tier label holder and the divider located in the upper tier laterally extends from the center panel coupled to the back panel of the upper tier to the pair of front edges located adjacent to and behind the upper tier label holder;

wherein the at least one divider located in the lower tier is positioned behind and along the lower label holder such that the lower label holder extends beyond the at least one divider located in the lower tier;

wherein the at least one divider located in the upper tier is positioned behind and along the upper label holder such that the upper label holder extends beyond the at least one divider located in the upper tier.

12. The wrapping holder display of claim 11 wherein the floor of the upper tier is located above the floor of the lower tier.

13. The wrapping holder display of claim 11 wherein the upper tier label holder is located above the lower tier label holder.

14. The wrapping holder display of claim 11, wherein the at least one divider located in the lower tier is made of a single, continuous clear material.

15. The wrapping holder display of claim 11, wherein the at least one divider located in the upper tier is made of a single, continuous clear material.

* * * * *